United States Patent [19]

Bockman et al.

[11] 4,343,352

[45] Aug. 10, 1982

[54] HEAT EXCHANGER FOR GASES

[75] Inventors: Ole K. Bockman, Oslo; Kjell Rydland, Ås, both of Norway

[73] Assignee: A/S Norsk Viftefabrikk, Oslo, Norway

[21] Appl. No.: 220,036

[22] PCT Filed: Apr. 9, 1980

[86] PCT No.: PCT/NO80/00012

§ 371 Date: Dec. 9, 1980

§ 102(e) Date: Dec. 5, 1980

[87] PCT Pub. No.: WO80/02193

PCT Pub. Date: Oct. 16, 1980

[30] Foreign Application Priority Data

Apr. 9, 1979 [NO] Norway ..... 791191

[51] Int. Cl.[3] ..... F28D 13/00; F28C 3/16

[52] U.S. Cl. ..... 165/104.16; 110/245; 122/4 D; 422/146

[58] Field of Search ..... 165/104.16; 34/57 A; 110/245; 422/146; 122/4 D; 62/57

[56] References Cited

U.S. PATENT DOCUMENTS

| | | | |
|---|---|---|---|
| 2,640,333 | 6/1953 | Bailey | 62/57 |
| 2,919,559 | 9/1956 | Koch | 62/305 |
| 3,048,153 | 8/1962 | Abrahamsen | 422/143 X |
| 3,814,176 | 6/1974 | Seth | 165/104 |
| 3,912,002 | 10/1975 | Elliott | 165/104.16 X |

FOREIGN PATENT DOCUMENTS

| | | | |
|---|---|---|---|
| 123737 | 12/1968 | Norway . | |
| 751444 | 4/1975 | Norway . | |
| 699151 | 10/1953 | United Kingdom | 165/104.16 |
| 1395900 | 10/1971 | United Kingdom . | |

*Primary Examiner*—Albert W. Davis

*Attorney, Agent, or Firm*—Howson and Howson

[57] ABSTRACT

Heat exchanger for gases, comprising a vertical shaft with upward flow of gas between rows of staggered horizontally disposed sets of tubes, downwardly restricted by a gas penetrable bottom (2) and upwardly by the uppermost set of tubes, and over its entire vertical length containing a granular material (7) which is kept in motion by the essentially vertically upward gas stream. The heat exchanger is characterized therein that the ratio between the diagonal free opening a and the horizontal free opening b between the tubes (4) in the set of tubes lies within the range 0.45:1–0.9:1 for controlling and restricting the vertical movement of the grains in the heat exchanger, thereby obtaining an approximately continuous temperature gradient in the gas-grain mixture over the entire height of the heat exchanger.

3 Claims, 4 Drawing Figures

HEAT EXCHANGER FOR GASES

FIELD OF THE INVENTION

The invention relates to a heat exchanger for gases, in which a granular material is kept in motion by means of an upward gas flow through the heat exchanger, heat exchange tubes containing a flowing medium to receive or give off heat being arranged in that section of the heat exchanger in which the granular material is kept in motion.

THE PRIOR ART

Heat transfer from a gas to a contact surface in a whirling layer or fluidized bed of granular material is known within the art. A such heat transfer process may offer substantial advantages. Very high heat transfer figures may be obtained. The strongly turbulent movement of grains against contact surfaces prevents deposition of impurities on the heating surfaces. Some types of e.g. contaminated waste gases are conducive to a substantial growth on the heating surfaces of conventional heat exchangers, which in such cases substantially reduces the usefulness of conventional heat exchangers. Fluidized bed heat exchangers are disclosed e.g. in British Pat. No. 1,395,900.

However, a such fluidized bed also has disadvantages which strongly restrict its usefulness for heat exchange purposes. The resistance towards the gas flow is high, the pressure drop across the bed corresponding to the weight of the fluidized bed, and in addition comes the necessity of maintaining a substantial pressure drop across the bottom. The pressure drop across the bottom must be at least 30% of the pressure drop of the fluidized bed, preferably substantially higher, in order to ensure good gas distribution. With an individual grain density of e.g. 2.6 in the fluidized bed (quartz) the density of a conventional fluidized bed will be within the range of from 800 to 1100 kg/m$^3$ within the conventional velocity range (of the gas) of 3–10×minimum fluidizing velocity. The corresponding pressure drop across the bed alone will be 800–1100 mm water column per m of bed height. This involves a very strong restriction of the height of a such bed.

Another property of a such fluidized bed is a perhaps still stronger restriction of the usefulness of the bed for heat exchange purposes. The random and strongly turbulent movement of the grains in the fluidized bed yields a continuous mixing and also an approximately complete temperature equalization throughout the bed. A such fluidized bed normally operates with through-passing gas bubbles which increase in size with increasing bed height and which give strong and random agitation throughout the bed. Several investigations have shown that the entire fluidized bed in a fluidized bed heat exchanger is approximately isothermal despite e.g. a continuous supply of heat by means of hot gas introduced through the bottom and despite a continuous cooling by means of heat transfer surfaces arranged in the bed. This isothermal state manifests itself as a substantial and easily measurable temperature drop when the gas passes through the bottom of the bed, the gas being momentarily cooled by contact with the fluidized bed. Then, as mentioned, the temperature is approximately constant throughout the bed, and the temperature of the out-going gas above the bed is approximately equal to the temperature immediately above the bottom.

If heat is to be transferred from a gas to a medium in a such bed, the efficiency of the process is restricted thereby that the temperature of the out-flowing and heated medium must always be lower than the temperature of the bed, this temperature being again approximately the same as the temperature of out-flowing cooled gas. It does not matter whether the heat transfer surface, e.g. in the form of tube sets in the bed, is arranged cocurrently, countercurrently or crosscurrently. As the temperature of the entire bed is constant, the same driving temperature difference is obtained in all cases.

The temperature profile over the height of the fluidized bed in a heat exchanger is fundamentally as shown in FIG. 1. In this figure is shown the theoretical gas temperature 1, the actual gas temperature and temperature of the fluidized bed 2 and the surface temperature 3 of the heat exchanger.

In most processes where hot gas (e.g. waste gas) is to be used for heating a heat-carrying medium (e.g. hot water or steam) countercurrent must be used in order to obtain an acceptable process economy. A good utilization of heat supplied by means of a gas demands a low temperature of the out-going gas. The usefulness of the heated medium for heating purposes or for energy recovery purposes (e.g. high pressure steam) demands that the temperature of the out-going medium is high.

In order to establish a countercurrent effect in a fluidized bed heat exchanger two or more separate fluidized bed sections in series are required, each having its own gas distribution bottom, and with the heat medium being passed countercurrently from section to section. For processes with high requirements to countercurrent efficiency, i.e. that the temperature of the out-going heated medium is to be substantially higher than the temperature of the out-going gas, several fluidized bed sections in series are required. This is a solution for which there is very limited applicability, inter alia because the pressure drop on the gas side easily becomes unreasonably high.

The invention to be subsequently described is a heat exchanger which operates with a grain/gas mixture in the contact zone, with the advantages thereby imparted in the form of good heat transfer and cleaning of the contact surfaces, however, with the number of grains and the movement thereof in the gas stream being restricted and controlled in such a manner that substantial fundamental and practical advantages are obtained compared with known fluidized bed heat exchangers.

SUMMARY OF THE INVENTION

Accordingly, the invention relates to a heat exchanger for gases, constructed as a vertical shaft with an upward flow of gas between rows of staggered horizontally arranged sets of tubes, downwardly restricted by a gas-penetrable bottom and upwardly by the uppermost set of tubes, and over its total vertical length containing a granular material which is kept in motion by means of the essentially vertically upward flow of gas, and the heat exchanger is characterized therein that the ratio between the diagonal free opening a and the horizontal free opening b between the tubes in the set of tubes is within the range of from 0.45:1 to 0.9:1, for controlling and restricting the vertical movement of the grains in the heat exchanger, to thereby obtain an approximately continuous temperature gradient in the gas-grain mixture over the entire height of the heat exchanger.

Further in accordance with the invention, the net gas velocity through the free flow cross-section of the heat exchanger lies within the transition range for pneumatic transportation of the grains corresponding to from 30 to 100 times the minimum fluidizing velocity.

According to a further embodiment of the invention, the sets of tubes for the transfer of heat are completely or partly in the form of tubes provided with fins and having a circular cross-section.

The present invention is based on a completely new principle, viz. a heat exchanger wherein the movement of the bed material is controlled by means of heat exchange tubes arranged in a certain pattern, so that the temperature in the bed is not equalized through uncontrolled circulation, whereby a strongly varying temperature is obtained up through the entire bed. For e.g. heating and vaporization of water through heat exchange with hot gas in a such bed, according to the invention a temperature of the out-going vapor (at the bottom) has been obtained which is far higher than the temperature of the gas leaving the bed (at the top). Water/vapor then pass through the bed (from above and downwards) countercurrently to the gas flow. This proves that a nonisothermal whirling bed has been provided with controlled movement of the bed material.

DETAILED DESCRIPTION OF THE PREFERRED EMBODIMENTS AND DRAWINGS

Figure 2:
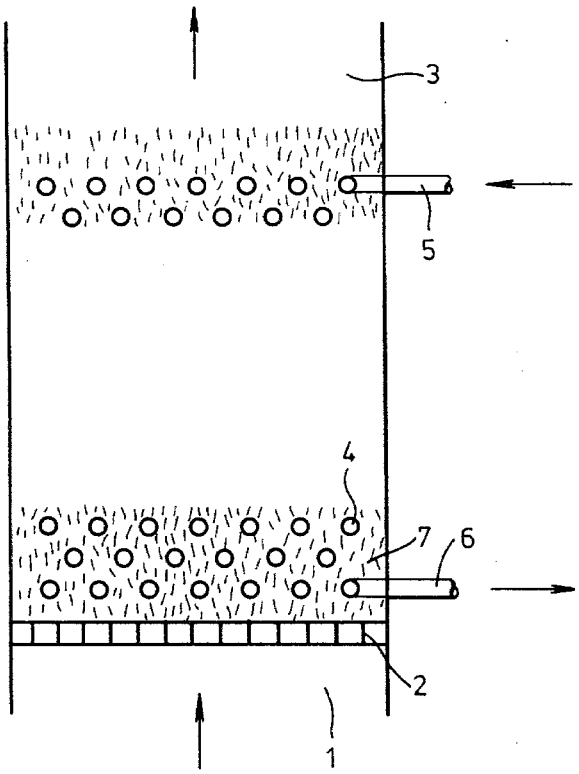
FIG. 2 shows a simplified section through a heat exchanger according to the invention.

A vertical section through a heat exchanger according to the invention is schematically shown in FIG. 2. For the disclosure a case has been chosen which comprises cooling of a hot gas and heating of a flowing medium, however, the reverse course is also completely conceivable. The apparatus comprises a hot gas 1 inlet chamber and, further, a bottom 2 which is penetrable to the gas and which provides a predetermined pressure drop in order to obtain good distribution of the gas. The heat exchanger section is upwardly restricted by an outlet chamber 3 for cooled gas. The heat transfer surface consists of an arrangement of horizontal sets of tubes 4 which may be smooth tubes, tubes externally provided with fins or a combination thereof and which normally, but not necessarily, are provided with an upper inlet 5 and a lower outlet 6 for the medium to be heated, whereby gas and the medium pass countercurrently through the heat exchanger. Into the free space between the sets of tubes in the heat exchange section a certain amount of granular material 7 has been filled. The bottom 2 may, but must not necessarily, be impenetrable to the grains 7 when the gas flow has been stopped, however, it must be impenetrable to the grains when the apparatus is used. This is obtained by selecting a such gas velocity through the holes or slots of the bottom 2 that it exceeds the velocity of fall of the heaviest grains.

A heat exchanger according to the invention is operated at such high gas velocities that net velocity between the tubes in the heat exchange section lies within the range of transition between the fluidizing velocity and the pneumatic transportation velocity for the grains, i.e. preferably within the range of 30–100-×minimum fluidizing velocity for the grains, more preferably within the range of 50–70×minimum fluidizing velocity for the grains. The latter range is 5–10×the normal velocity range of a fluidized bed. The net velocity decreases owing to the increased free cross-sectional area above the uppermost set of tubes, whereby the grains are not blown out of the apparatus, but may only move up to a limited height in the outlet chamber 3.

A heat exchanger according to the invention works, contrary to a normal fluidized bed, with controlled movement of both gas and grains within the entire exchange section. In order to obtain a such controlled movement of the gas-grain mixture the sets of tubes must be arranged in a manner which gives a special pattern for controlling the movement of the gas and the grains in the free space between the tubes of the sets of tubes.

Figure 3:
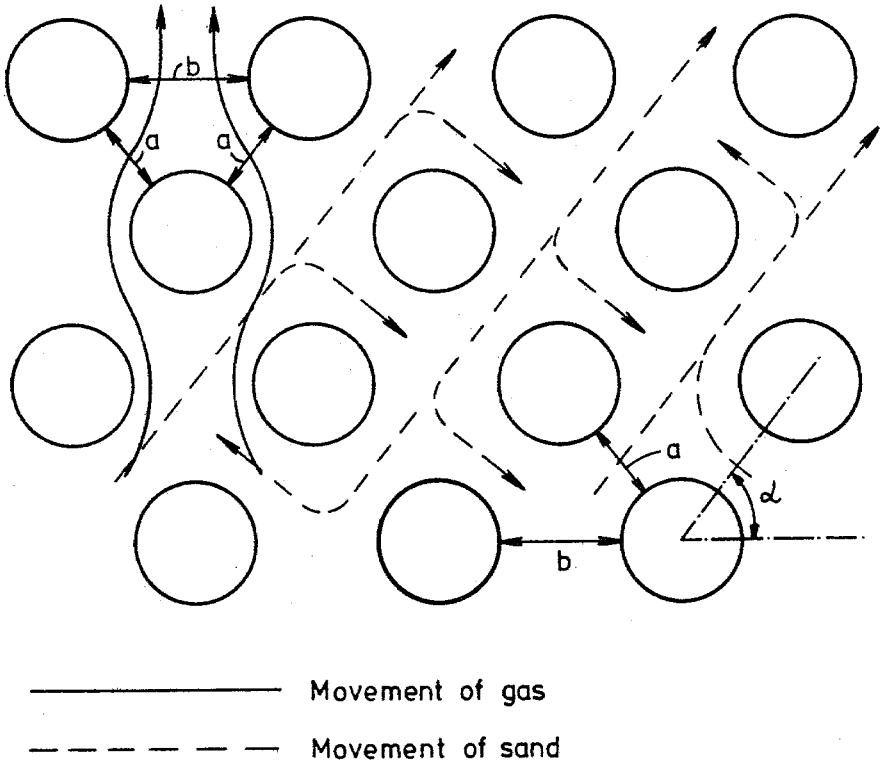
FIG. 3 schematically shows an end view of the arrangement of the heat exchange tubes of the sets of heat exchange tubes used in the heat exchanger according to the invention.

The arrangement in order to obtain a such controlled movement comprises according to the invention an essentially staggered distribution of tubes as shown in cross-section in FIG. 3. The movement of the gas thereby becomes an upward wave movement as shown in the figure. Further, according to the invention the diagonal angle $\alpha$ between the tubes and the diagonal/-horizontal free cross-section distance 2a/b should be held within certain minimum and maximum limits. It has been found that the angle should be within the range 30°–65°, preferably 37°–58°, and the ratio 2a/b within the range 0.9:1–1.8:1, preferably 1:1–1.7:1. These parameters cannot be freely selected with regard to one another because the free cross-section of flow through the set of tubes ought to, but must not necessarily, be within the range 45–65% of the gross cross-section of the apparatus in order to obtain a reasonable dimensioning of the entire apparatus. Further, regard must be taken thereto that the volume of the gas flowing through the heat exchanger varies with the temperature across the heat exchanger. The final choice of the type and the size of the grains is based on the carrying velocity of the gas in the exchange section.

By the proper selection of the above-mentioned parameters there is obtained according to the invention a controlled grain movement as shown in FIG. 3, where the movement of the grains is mainly restricted to a movement parallel to the diagonal angle in the division between the sets of tubes. Further, a strongly restricted length of movement of the grains in the diagonal direction is obtained, and, what is of particular importance, also a correspondingly restricted vertical resultant for the maximum movement of the grains.

A heat exchanger according to the invention obtains completely special properties which distinguish it substantially from and yield essential advantages compared with a fluidized bed heat exchanger with built-in, optionally tubular heat transfer surfaces and having fluidized bed function. A practical example will illustrate the advantages of the invention.

EXAMPLE

A heat exchanger according to the invention having an approximately 1.5 m high heat exchange section, has been tested for cooling strongly impurity-laden flue gas using air as cooling medium in countercurrent in the lower portion of the exchanger and water in countercurrent in the upper portion of the exchanger. The height of the exchanger was arbitrarily chosen. A heat exchanger according to the invention may be built substantially higher because it does not seem to be any theoretical restriction as regards the height.

The total pressure across the entire exchanger including the bottom was about 350 mm WC (water column). The gas velocity in the net cross-section of the exchanger was 8.6–13.0 m/sec. The temperature of the in-coming gas was 500° C.

Figure 4:
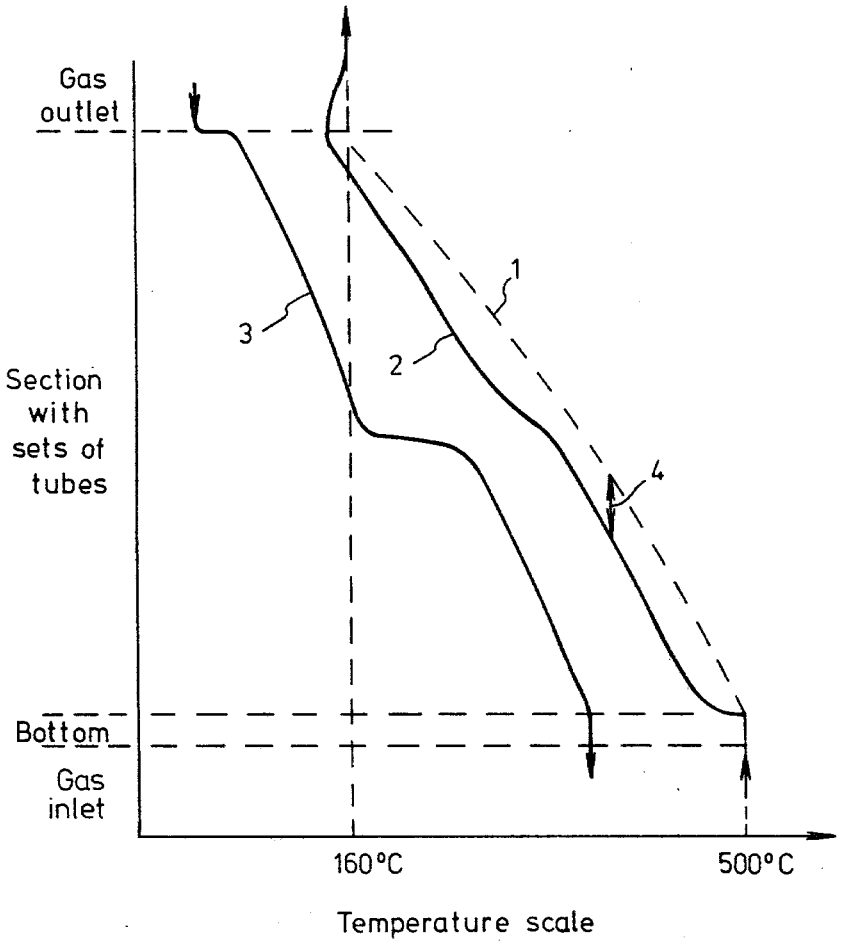
FIG. 4 schematically shows the temperature variation over the height of the bed in a heat exchanger according to the invention.

The temperature profiles over the height of the exchanger were measured and are shown in FIG. 4, where 1 denotes the theoretical variation of the gas temperature, calculated on the basis of the amount of heat transferred from the gas up to any level, 2 denotes the measured temperature profile in the gas-grain mixture, and 3 denotes the calculated wall temperatures of the tubes in the heat exchanger.

In this heat exchanger a non-isothermal course is obtained over the entire height of the exchanger, with a temperature gradient in the gas-grain mixture which is very close to the theoretical course of the gas temperature throughout the exchanger.

The deviation 4 between theoretical gas temperature and the actual gas-grain temperature is due to the restricted vertical movement and the back-mixing of grains in the sets of tubes of the heat exchanger.

The dust in the strongly impurity-laden gas which was used for the experiment (metallurgical flue gas) is inclined to rapid growth onto and isolation of cooled heat transfer surfaces. The cooling surfaces of this exchanger were maintained essentially clean due to the movement of the grains. The heat transfer figures obtained between the gas-grain mixture and the transfer surfaces were high, 80–120 $W/m^2$ °C. This is much higher than for a pure gas heat exchanger with corresponding gas velocities, and approximately the same as for a fluidized bed heat exchanger when considering the extremely low density of the gas-grain mixture.

Figure 1:
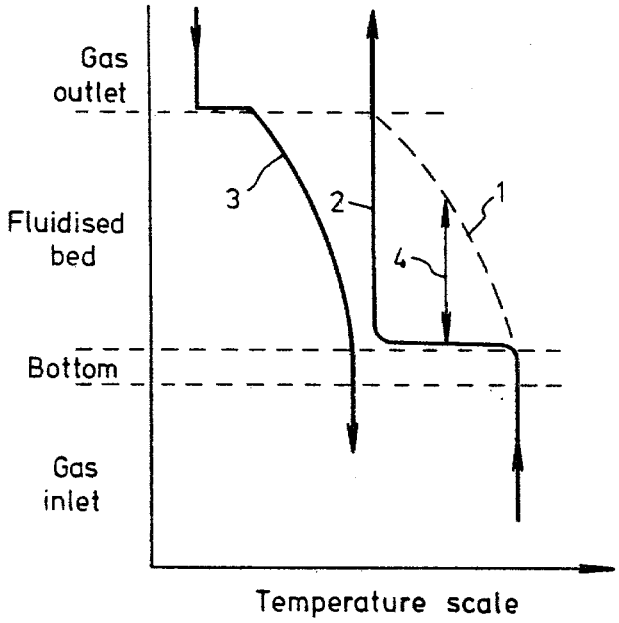
FIG. 1 schematically shows the temperature distribution over the height of a fluidized bed in a heat exchanger. The theoretical gas temperature has been denoted by 1, the actual temperature of the gas and the fluidized bed has been denoted by 2, and the surface temperature of the heat exchanger has been denoted by 3.

The difference between the physical conditions in a fluidized bed heat exchanger and a heat exchanger with controlled movement of the grains clearly appears from a comparison between FIG. 1 and FIG. 4. The deviation (the isothermistry) 4 is 100% at all levels of the fluidized bed according to FIG. 1 wherein the movement of the grains is uncontrolled and the temperature equalization complete over the entire height of the heat exchanger. If the course of progress shown in FIG. 1 had been applied to FIG. 4, the gas-sand temperature throughout the exchanger would have been about 160° C., and the maximum temperature of the tube walls in the heat exchanger would be below this limit irrespective of the higher heat transfer figures in a such bed. The pressure drop across a fluidized bed heat exchanger having a height of 1.5 m would be approximately 2000 mm WC, including the bottom, and the amount of gas through a heat exchanger of corresponding cross-section would be about $\frac{1}{3}$–1/5 of the capacity of the heat exchanger according to the invention.

The heat exchanger according to the invention departs from fluidized bed heat exchangers therein that it has been constructed for operating at gas velocities which are not within the fluidizing range, but within the transition range towards pneumatic transportation, therein that the density of the gas-grain mixture and thereby the pressure drop across the exchanger are correspondingly much lower, and therein that the movement of the grains is controlled and restricted instead of random and total, with the result that the mixture of gas-grain obtains a temperature gradient approximating the theoretical course of temperature over the height of the exchanger, in contrast to the isothermal course in a fluidized bed heat exchanger.

Thus, because a heat exchanger according to the invention at completely essential points departs from a fluidized bed heat exchanger, the heat exchanger according to the invention may be called a semi-pneumatic or dynamic bed heat exchanger.

We claim:

1. Heat exchanger for gases, constructed as a vertical shaft with upward gas flow between rows of staggered, horizontally disposed sets of tubes, downwardly restricted by a gas-penetrable bottom (2) and upwardly by the uppermost set of tubes, and over its entire vertical length containing a granular material (7) which is kept in motion by means of the essentially vertically upward flow of gas, characterized in that the ratio between the diagonal free opening a and the horizontal free opening b between the tubes (4) in the set of tubes is within the range 0.45:1–0.9:1 for controlling and restricting the vertical movement of the grains in the heat exchanger, thereby obtaining an approximately continuous temperature gradient in the gas-grain mixture over the entire height of the heat exchanger.

2. A heat exchanger as claimed in claim 1, wherein the net gas velocity through the free flow cross-section of the exchanger is within the range of transition for pneumatic transportaion of the grains and corresponding to 30–100 times the minimum fluidizing velocity.

3. A heat exchanger as claimed in claim 1 or 2, characterized in that the sets of tubes for heat transfer are completely or partly in the form of tubes provided with fins and having circular cross-section.

* * * * *